US006971763B2

(12) United States Patent
Baldo et al.

(10) Patent No.: US 6,971,763 B2
(45) Date of Patent: Dec. 6, 2005

(54) ADAPTER FOR ANNULAR FLUORESCENT LAMPS HAVING AN INTEGRATED BALLAST AND STARTING ARRANGEMENT

(75) Inventors: Lorenzo Baldo, Giavera del Montello (IT); Moreno Marton, Mogliano Veneto (IT)

(73) Assignee: Patent-Treuhand-Gesellschaft fur Elektrisch Gluhlampen mbH, Munich (DE)

( * ) Notice: Subject to any disclaimer, the term of this patent is extended or adjusted under 35 U.S.C. 154(b) by 68 days.

(21) Appl. No.: 10/695,783

(22) Filed: Oct. 30, 2003

(65) Prior Publication Data

US 2004/0240158 A1 Dec. 2, 2004

(30) Foreign Application Priority Data

Nov. 15, 2002 (DE) ..... 102 53 363

(51) Int. Cl.[7] ..... F21V 7/10
(52) U.S. Cl. ..... 362/216; 362/147; 362/260; 362/457; 313/49
(58) Field of Search ..... 362/147, 216, 362/260, 404, 434, 441, 457; 313/49–51

(56) References Cited

U.S. PATENT DOCUMENTS 3,673,402 A * 6/1972 Weiss ..... 362/220
4,161,020 A * 7/1979 Miller ..... 362/216
4,278,911 A * 7/1981 Metoff ..... 313/318.04
4,406,969 A * 9/1983 Haraden et al. ..... 313/318.01
4,410,834 A * 10/1983 Witte et al. ..... 315/58
4,454,451 A * 6/1984 Metoff ..... 315/58
5,236,157 A * 8/1993 Reggiani ..... 248/27.1
6,748,986 B2 * 6/2004 Chamba ..... 141/358
2004/0234179 A1 * 11/2004 Chen ..... 384/49

FOREIGN PATENT DOCUMENTS

DE 198 22 460 11/1999
WO WO 99/60672 * 11/1999 ..... H01R 33/94

* cited by examiner

*Primary Examiner*—Stephen Husar
*Assistant Examiner*—Jason Han
(74) *Attorney, Agent, or Firm*—Carlo S. Bessone

(57) ABSTRACT

The invention relates to an adapter (1) having an integrated ballast and starting arrangement for annular fluorescent lamps (2) having a pin base (3) for connecting them to conventional incandescent lamp sockets. The adapter (1) has a cuboidal housing and has at each end a holder which partially encloses the pin base (3) of the fluorescent lamp (2) or the discharge vessel (12) of the fluorescent lamp (2). The first holder in this case also contains a socket for accommodating and making electrical contact with the pin base (3) and the other holder contains a sliding apparatus for locking the lamp (2).

7 Claims, 5 Drawing Sheets

ADAPTER FOR ANNULAR FLUORESCENT LAMPS HAVING AN INTEGRATED BALLAST AND STARTING ARRANGEMENT

TECHNICAL FIELD

The invention relates to an adapter having an integrated ballast and starting arrangement for annular fluorescent lamps having a pin base for connecting the adapter to conventional incandescent lamp sockets, the adapter having a housing for accommodating the integrated ballast and starting arrangement and a concentric attachment, having a screw or bayonet base, being attached to this housing, the housing having a substantially cuboidal configuration and lying substantially within the space enclosed by the annular fluorescent lamp, and a holder, which partially encloses the pin base of the fluorescent lamp or the discharge vessel of the fluorescent lamp, being attached to each of the two ends of the housing, the first holder also containing a socket for accommodating and making electrical contact with the pin base. Of particular interest here is an adapter for compact annular fluorescent lamps which are widely used in place of incandescent lamps.

BACKGROUND ART

U.S. Pat. No. 4,454,451 discloses a lamp unit comprising an annular fluorescent lamp and an adapter for connecting it to conventional screw bases for incandescent lamps. The adapter also has, in addition to support arms for mechanically holding the lamp, a flexible connecting unit, which is structurally separate from these mechanical support arms, having a base connecting part for electrical connection purposes which rests on one of the mechanical support arms. In addition, this adapter has a very voluminous central housing part for accommodating the ballast and starting arrangement, which part does not allow for installation in correspondingly narrowly dimensioned luminaires.

PCT laid-open specification WO 99/60672 discloses an adapter which has essentially the configuration described in the introduction. In order to lock the annular fluorescent lamp in place, the adapter has a snap-on apparatus in the form of two extensions, in the form of hooks, of the narrow side walls of the housing on which the fluorescent lamp rests, and an extension of the bottom plate in the form of a resilient tongue which partially encloses the fluorescent lamp from the side opposite the extensions, in the form of hooks, and presses against these extensions, in the form of hooks. This locking has the disadvantage that, when the housing, and in particular the resilient tongue, is made of plastic, this tongue loses its resilience over the course of time owing to light being radiated in, in particular from the fluorescent lamp itself, and can break when the lamp is changed.

DISCLOSURE OF THE INVENTION

The object of the present invention is to provide a construction which does not exhibit any fatigue phenomena, even when plastic is used as material for the housing of the adapter and when light is radiated in, which lead to the holding properties being impaired and possibly to the adapter being destroyed when the lamp is changed.

The adapter should be designed such that it can be assembled simply and rapidly with the fluorescent lamp. In addition, the adapter should allow for the lamp to be firmly seated in the adapter independently of the mounting position of the lamp.

In the case of the adapter having an integrated ballast and starting arrangement for annular fluorescent lamps having a pin base for connecting the adapter to conventional lamp sockets, the adapter having a housing for accommodating this integrated ballast and starting arrangement and a concentric attachment, having a screw or bayonet base, being attached to this housing, the housing having a substantially cuboidal configuration and lying substantially within the space enclosed by the annular fluorescent lamp, and a holder, which partially encloses the pin base of the fluorescent lamp or the discharge vessel of the fluorescent lamp, being attached to each of the two ends of the housing, the first holder also containing a socket for accommodating and making electrical contact with the pin base, this object is achieved in that the second holder has a sliding apparatus for locking the annular fluorescent lamp.

The sliding apparatus makes it possible to secure the lamp in the adapter in a permanent as well as vibration-resistant manner which holds the lamp securely both in the suspended mounting position with the adapter base pointing upward and in the upright mounting position with the adapter base pointing downward and in the perpendicular mounting position with the adapter base pointing to the side. At the same time, the lack of resilience in the case of the plastic holder for the lamp rules out the possibility of a resilient holding part breaking as a result of material fatigue.

The ballast and starting arrangement is advantageously mounted on a board. Mounting the clamping contacts of the pin base socket on a board which is electrically connected to this ballast and starting arrangement board, or—more advantageously—directly on this ballast and starting arrangement board, further simplifies the production of the adapter.

The housing of the adapter is optimally assembled from a lower part, an upper part and a sliding part.

The first holder with the pin base socket advantageously comprises in each case at least one extension, in the form of a hook, of the lower part and at least one extension, in the form of a hook, of the upper part of the housing, which together enclose the fluorescent lamp in the form of a semicircle.

Furthermore, the second holder with the sliding apparatus advantageously has at least one extension, in the form of a hook, of the lower part of the housing, on which the fluorescent lamp rests, as well as the sliding part, the sliding part having at least one extension, in the form of a hook, resting on the upper part of the housing and being capable of being displaced in the direction of the longitudinal axis of the housing for the purpose of locking the lamp.

For the purpose of holding the sliding part, the latter has a U-shaped cross section having in each case one rib which extends in the longitudinal direction of the adapter housing, close to the free ends of the two flanks, and engages in a corresponding groove on the inside of the side walls of the housing lower part.

In addition, the sliding part can have, on the two flanks, a locking part in the form of a rectangular section which is cut out of the flank wall and is fixedly connected to the flank wall only on the side remote from the housing lower part. The locking is achieved by projections which are in the form of saw teeth, are provided on the outside, close to the edge of the locking part facing the housing lower part, and engage in corresponding projections, in the form of saw teeth, on the inner wall of the housing lower part. If the two rectangular sections located on the flanks of the sliding part are pressed slightly against one another, the projections, in the form of saw teeth, of the rectangular section are lifted off the opposite projections, in the form of saw teeth, on the inner wall of the housing lower part and allow the sliding part to be moved freely. If the rectangular sections are released again, the two projections, in the form of saw teeth, on the sliding part engage in their counterpieces on the base lower part again and lock the sliding part.

BRIEF DESCRIPTION OF THE DRAWINGS

The invention is to be explained in more detail below with reference to an exemplary embodiment. In the drawing.

BEST MODE FOR CARRYING OUT THE INVENTION

Figure 1:
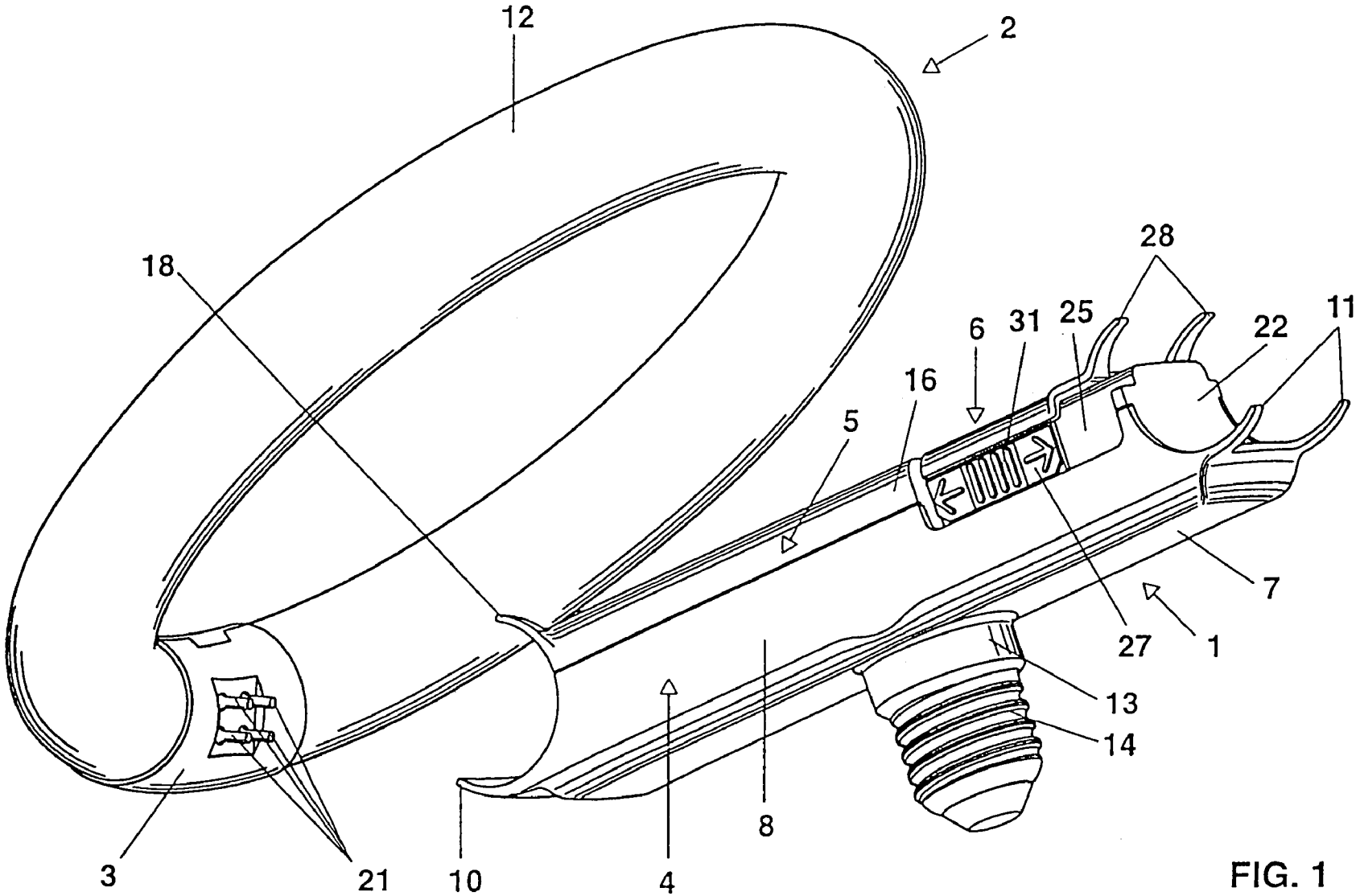
FIG. 1 shows a perspective side view of an adapter according to the invention with a compact annular fluorescent lamp not yet inserted.
Figure 2A:
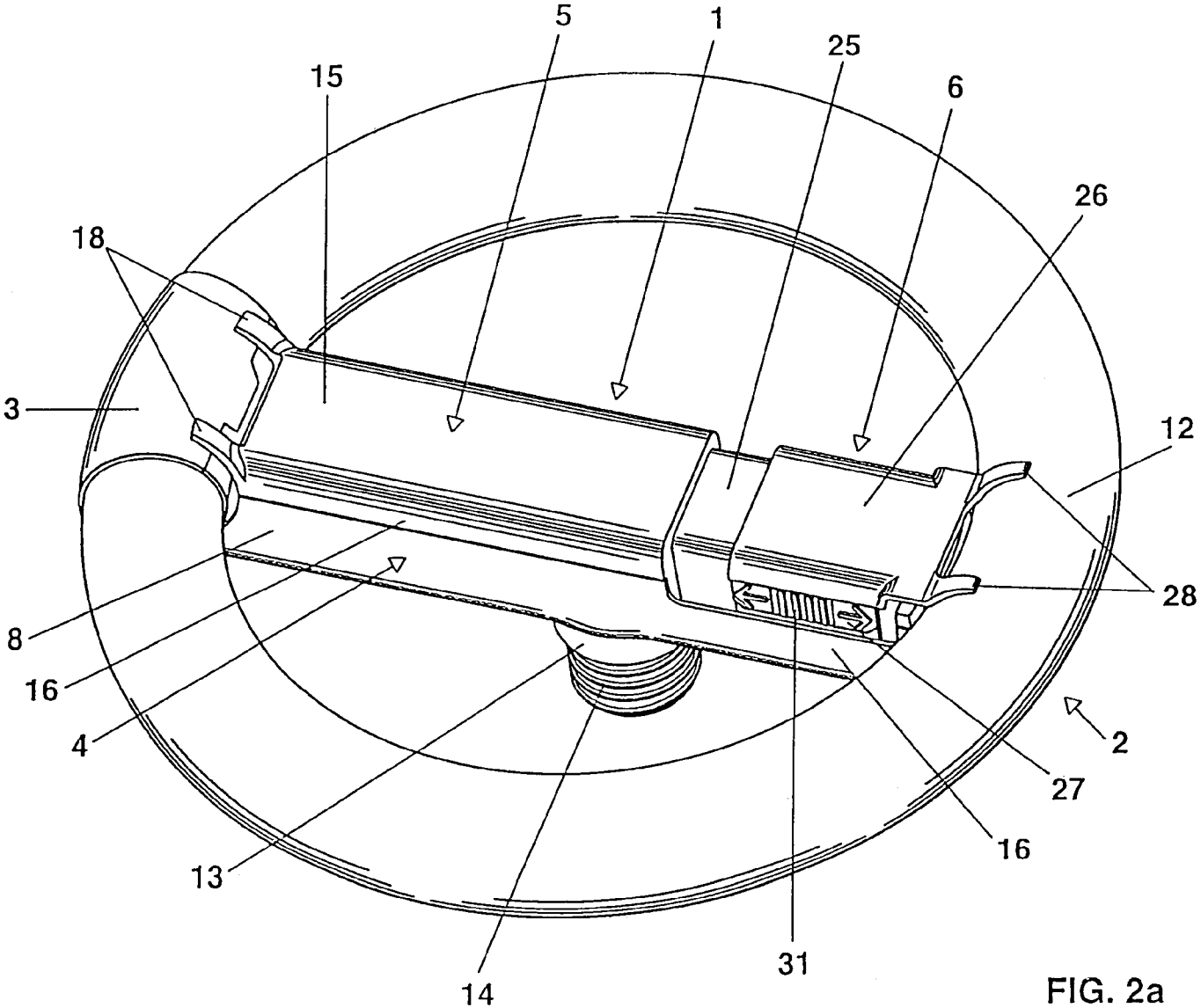
FIG. 2*a* shows a perspective plan view of the adapter shown in FIG. 1 with a compact annular fluorescent lamp inserted.
Figure 2B:
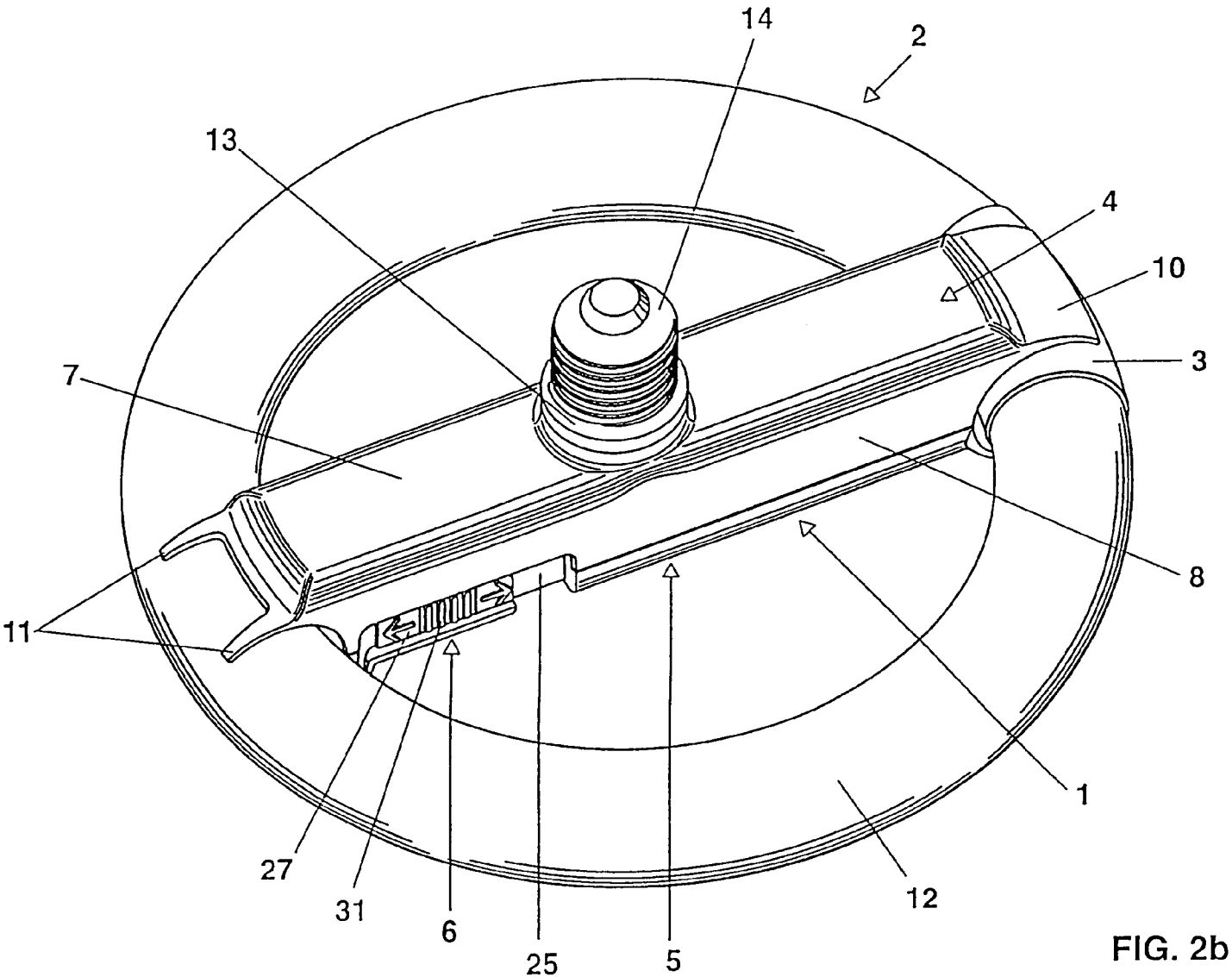
FIG. 2*b* shows a perspective view from below of the adapter shown in FIG. 1 with a compact annular fluorescent lamp inserted.
Figure 3A:
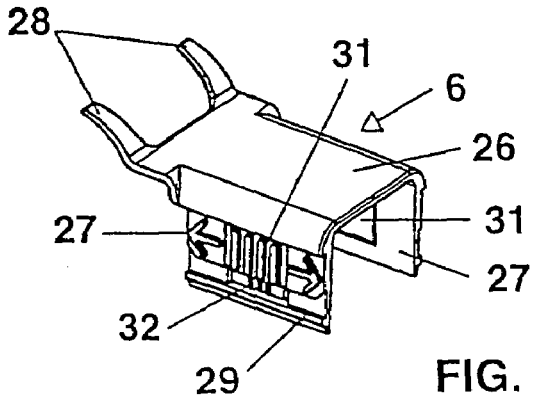
FIG. 3*a* shows a perspective side view of the sliding part of the adapter shown in FIG. 1.
Figure 3B:
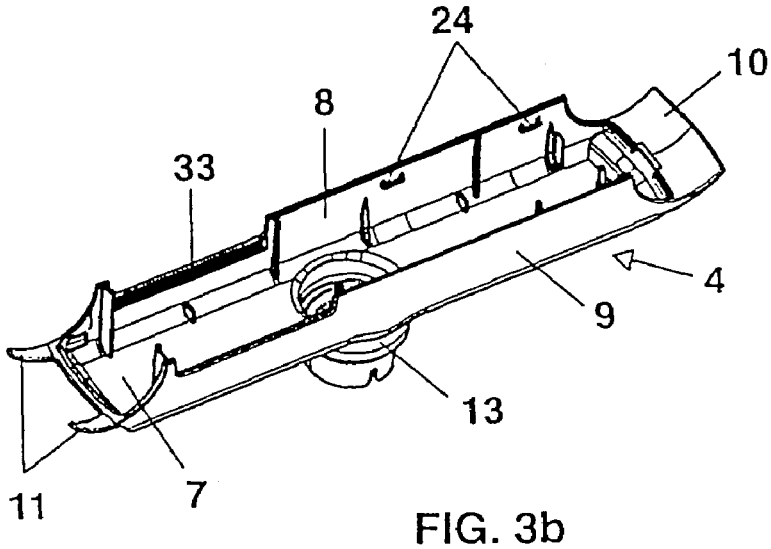
FIG. 3*b* shows a perspective plan view of the housing lower part of the adapter.
Figure 3C:
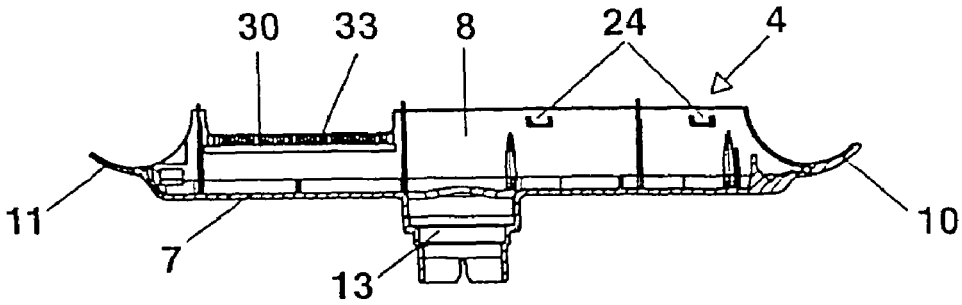
FIG. 3*c* shows a sectioned side view of the housing lower part of the adapter.
Figure 3D:
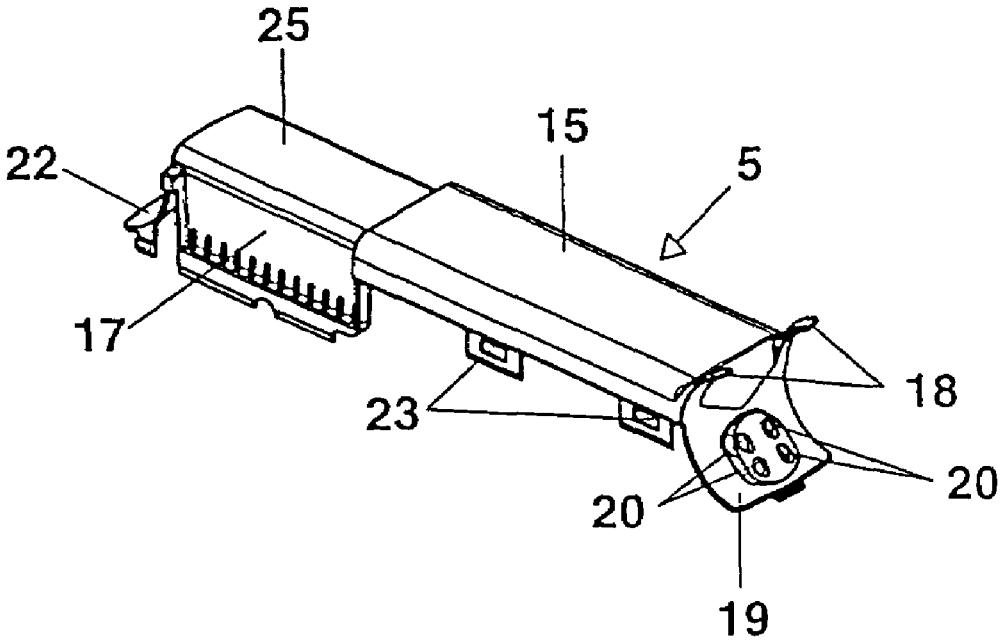
FIG. 3*d* shows a perspective plan view of the housing upper part of the adapter.
Figure 3E:
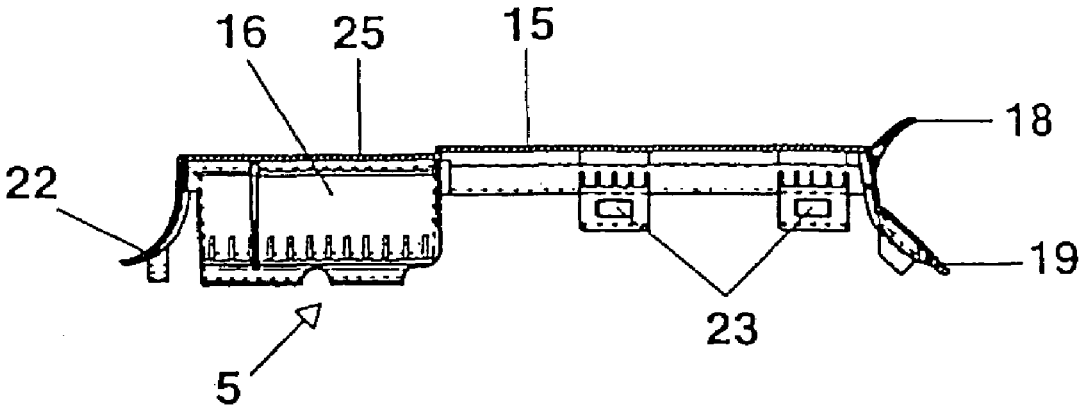
FIG. 3*e* shows a sectioned side view of the housing upper part of the adapter.

FIG. 1 shows a perspective plan view of an adapter 1 according to the invention with the annular compact fluorescent lamp 2 not yet inserted. The compact fluorescent lamp 2 is equipped with a pin base 3 of the type G 10q and has a power rating of 30 W. FIGS. 2*a* and 2*b* show a perspective plan view and a perspective view from below, respectively, of the adapter 1 from FIG. 1 with the compact fluorescent lamp 2 inserted.

As can be seen in FIGS. 2*a* and 2*b* as well as in the subsequent FIGS. 3*a* to 3*e*, the housing of the adapter 1 comprises a lower part 4, an upper part 5 and a sliding part 6.

The housing lower part 4 has a bottom plate 7 having an essentially rectangular base surface and two side walls 8, 9. An extension 10, which is in the form of a hook and bears the plastic part of the pin base 3 of the lamp 2, is integrally formed on one narrow end of the bottom plate 7, and two extensions 11, which are in the form of hooks and bear the part of the discharge vessel 12 which is diametrically opposite the base 3, are integrally formed on the opposite end. In addition, a concentric shell 13 is integrally formed on the bottom plate 7 and, in the assembled state, a screw base 14 of the type E 27 is attached to the shell.

The housing upper part 5 comprises a cover plate 15 having a substantially rectangular bottom and two wide side walls 16, 17. Two extensions 18, which are in the form of hooks and partially enclose the plastic part of the pin base 3 of the lamp 2 from above, are integrally formed on one narrow end of the cover plate 15. In addition, a bent narrow side wall 19 is integrally formed which has holes 20 for inserting the connecting pins 21 of the pin base 3. A bent narrow side wall 22 is likewise integrally formed on the other narrow end of the cover plate 15. In order to connect the housing lower and upper parts, the two wide side walls 16, 17 of the upper part 5 have in each case two extensions 23, in the form of lugs, having in each case one opening into which U-shaped projections 24 on the inside of the side walls 8, 9 latch during assembly and form a connection which is no longer releasable. The housing upper part 5 has a set-back section 25 in the region in which the sliding part is displaceably seated.

The sliding part 6 has a U-shaped cross section having a cover plate 26 and two flanks 27, two extensions 28, in the form of hooks, being integrally formed on the cover plate for the purpose of enclosing the discharge vessel 12 of the annular fluorescent lamp 2. Ribs 29 which extend parallel to the longitudinal direction of the base housing are mounted on the outer wall of the two flanks 27, close to the free ends of the flanks 27, which engage in a groove 30 running along the inner wall of the housing lower part and, in this manner, allow for the sliding part to be displaced in the direction of the longitudinal axis of the adapter 1.

A locking part in the form of a rectangular section 31, which is cut out of the flank wall and is fixedly connected to the flank wall 27 only on the side remote from the base lower part 4, is provided on the two flanks 27 of the sliding part 6. The locking part has, on the outside, close to the edge facing the base lower part, projections 32, which are in the form of saw teeth and, when the adapter is assembled, engage in corresponding projections 33, in the form of saw teeth, on the inside of the side walls 8, 9 of the base lower part 4.

What is claimed is:

1. An adapter for an annular fluorescent lamp, the adapter comprising: a housing having two ends and a set-back section and including a concentric attachment having a screw or bayonet base for connection to a conventional incandescent lamp socket attached to the housing, the housing having a substantially cuboidal configuration and lying substantially within the space enclosed by an annular fluorescent lamp, and a first and a second holder attached respectively to the two ends of the housing, the first holder also containing a pin base socket for accommodating and making electrical contact with the fluorescent lamp and the second holder having a sliding apparatus displaceably seated in the set-back section of the housing for locking the annular fluorescent lamp.

2. The adapter as claimed in claim 1, wherein the housing of the adapter is assembled from a lower part, an upper part and a sliding part.

3. The adapter as claimed in claim 1, wherein the first holder with the pin base socket comprises at least one extension, in the form of a hook, of a lower part and at least one extension, in a form of a hook, of an upper part of the housing, which together enclose the fluorescent lamp in a form of a semicircle.

4. The adapter as claimed in claim 1, wherein the second holder with the sliding apparatus comprises at least one extension, in a form of a hook, of a lower part of the housing, on which the fluorescent lamp rests, as well as a sliding part, the sliding part having at least one extension, in a form of a hook, for holding the discharge vessel, resting on an upper part of the housing and being capable of being displaced in a direction of a longitudinal axis of the housing for locking the fluorescent lamp.

5. The adapter as claimed in claim 4, wherein the sliding part has a U-shaped cross section having one rib which extends in the longitudinal direction of the housing, close to free ends of two flanks, the rib engaging in a corresponding groove on an inside of side walls of a lower part of the housing.

6. The adapter as claimed in claim 4, wherein the sliding part has, on two flanks, a locking part in a form of a rectangular section which is cut out of a flank wall and is fixedly connected to the flank wall only on a side remote from a lower part of the housing.

7. The adapter as claimed in claim 6, wherein the locking part has projections, in a form of saw teeth, on an outside, close to an edge facing a lower part of the housing, which projections, when the adapter is assembled, engage in corresponding projections, in a form of saw teeth, on an inside of side walls of the lower part of the housing.

* * * * *